United States Patent [19]

Dokmo et al.

[11] 4,426,834

[45] Jan. 24, 1984

[54] APPARATUS FOR WRAPPING CONDUIT WITH SHEET MATERIAL

[76] Inventors: Richard C. Dokmo, 108 Crooked Creek Trail, Barrington, Ill. 60010; Ernest M. Hepler, 2726 Central St. #4-B, Evanston, Ill. 60201; Paul Holmstrand, 5217 N. Glenwood, Chicago, Ill. 60640

[21] Appl. No.: 330,213

[22] Filed: Dec. 14, 1981 (Under 37 CFR 1.47)

[51] Int. Cl.[3] ..... B65H 81/08; B65H 81/02

[52] U.S. Cl. ..... 57/10; 57/3; 57/6; 242/7.01

[58] Field of Search ..... 57/3, 6, 10, 31; 242/7.01

[56] References Cited

U.S. PATENT DOCUMENTS 2,923,486 2/1960 Betzel ..... 57/10 X
3,789,594 2/1974 Rees ..... 57/10
4,196,863 4/1980 Sakauc ..... 57/10 X
4,346,550 8/1982 Ferree ..... 57/10

*Primary Examiner*—Donald Watkins
*Attorney, Agent, or Firm*—McWilliams, Mann, Zummer & Sweeney

[57] ABSTRACT

Apparatus is disclosed for wrapping strips of sheet material in tape form around a pipe or conduit having a generally circular cross-sectional external shape. The apparatus includes a frame assembly having a pair of annular frame members connected by a desired number of frame cross members for structural support, each frame member being hinged to open around a conduit; a guide roller assembly including a plurality of drive wheels angularly adjustable with respect to the conduit being wrapped to vary the angle of the drive rollers with respect to the conduit being wrapped for varying the amount of sheet material overlap; a plurality of support rollers connected to the frame; a sheet material feeding assembly; a sheet material tensioning assembly; and a tape backing material take off assembly.

11 Claims, 5 Drawing Figures

APPARATUS FOR WRAPPING CONDUIT WITH SHEET MATERIAL

FIELD OF THE INVENTION

The present invention relates to an apparatus capable of wrapping strips of sheet material in tape form around a pipe or conduit having a generally circular cross-sectional external shape. More particularly, the present invention relates to a pipe or conduit wrapping device capable of wrapping a protective strip of tape around elongated conduits of various diameters in a helical or "cigarette wrap" manner with a predetermined and consistent amount of tape overlap under consistent tape tension to achieve efficient and complete tape adherence and exceptional corrosion resistance.

SUMMARY OF THE INVENTION

In brief, the apparatus of the present invention includes a frame assembly comprising a pair of axially spaced annular frame members connected by a desired number of longitudinal frame cross-members for structural support wherein each frame member is hinged to open so that the apparatus may be initially disposed around a conduit for tape wrapping; and drive roller assembly including a plurality of drive wheels angularly adjustable with respect to the conduit being wrapped to adjust the apparatus for the purpose of achieving a predetermined amount of tape overlap; a plurality of free wheeling support rollers connected to the frame; a sheet material feeding assembly; a sheet material tensioning assembly; and a tape backing material take-off assembly.

Accordingly, an object of the present invention is to provide new and improved apparatus for helically wrapping a conduit with a strip of sheet material.

Another object of the present invention is to provide new and improved apparatus for wrapping a conduit with a strip of sheet material in tape form including a plurality of free-wheeling frame support wheels or casters capable of axial and radial rotation capable of automatic angular adjustment with respect to the conduit.

Another object of the present invention is to provide new and improved apparatus for wrapping a conduit with a strip of tape material including a guide roller assembly having a plurality of conduit-contacting drive rollers simultaneously adjustable to a predetermined angle with respect to the conduit.

Another object of the present invention is to provide new and improved apparatus for wrapping a conduit with a strip of sheet material including a drive roller angular adjustment assembly for adjustably disposing frame carried drive rollers angularly with respect to the longitudinal axis of the conduit being wrapped.

Another object of the present invention is to provide new and improved apparatus for wrapping a conduit with a strip of sheet material including a sheet material feeding assembly having a sheet material tensioning member angularly adjustable with respect to the conduit.

Another object of the present invention is to provide new and improved apparatus for wrapping a conduit with a strip of tape material including a simplified slotted tape material tensioning assembly spaced from a tape material feed roll to provide a constant amount of tape tension independent of a given tape roll diameter.

Another object of the present invention is to provide a new and improved apparatus for wrapping a conduit with a strip of sheet material in tape form including a new and improved locking mechanism for securing a roll of tape to the sheet material feeding assembly in a rotatable manner while locking the roll of tape securely to the assembly.

Another object of the present invention is to provide new and improved apparatus for wrapping tape over an exterior surface of a conduit including a new and improved backing material take-off spindle for removing and collecting the tape backing material from the tape prior to application of the tape onto the surface of the conduit.

Another object of the present invention is to provide a sheet material feeding assembly including a new and improved mechanism for releaseably maintaining a roll of sheet material on a material feed reel.

Another object of the present invention is to provide a new and improved hinge mechanism connecting a frame member to the sheet material feeding assembly thereby providing a simplified mechanism for angularly adjusting the sheet material feeding assembly with respect to the conduit.

BRIEF DESCRIPTION OF THE DRAWINGS

For a better understanding of the present invention, reference should be had to the following detailed description taken in conjunction with the drawings, in which.

DETAILED DESCRIPTION OF A PREFERRED EMBODIMENT

Figure 1:
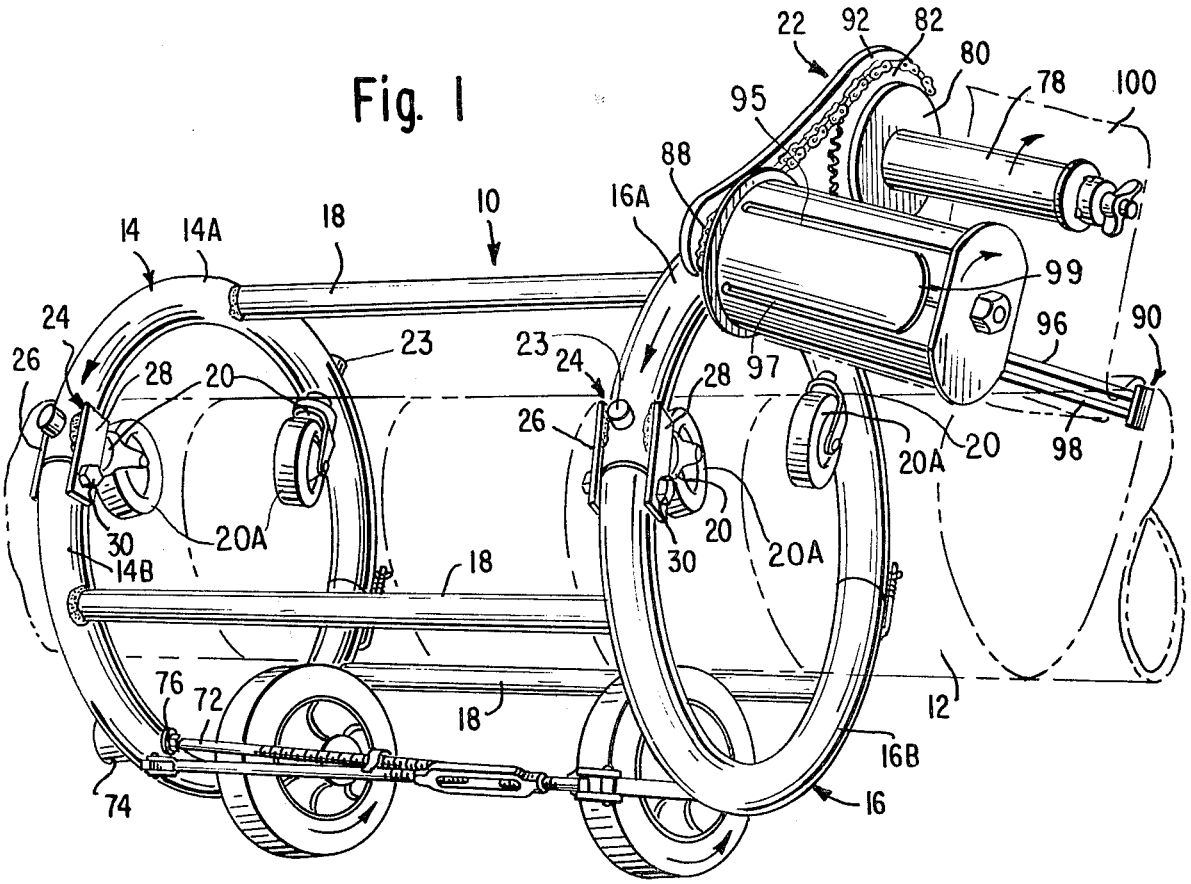
FIG. 1 is a perspective view of a new and improved apparatus for wrapping a conduit with a strip of sheet material, shown rotatably secured to a conduit during tape wrapping.

Referring now to the drawings, and initially to FIG. 1, there is illustrated a new and improved device, generally designated by reference numeral 10, for wrapping a conduit 12, having a generally circular exterior cross section with sheet material in tape form.

The apparatus 10 includes a frame assembly having a pair of annular frame members 14 and 16 axially spaced and connected by a plurality of structural cross members 18 for structural support and for grasping in manual rotation of the apparatus 10. Each annular frame member 14 and 16 carries a plurality of freely rotating casters 20 having wheels 20A for supporting the apparatus against the conduit 12 during helical rotation around the conduit 12. The caster wheels 20A are axially rotatable about wheel axles 21 and radially rotatable about radial caster pins 23.

Figure 3:
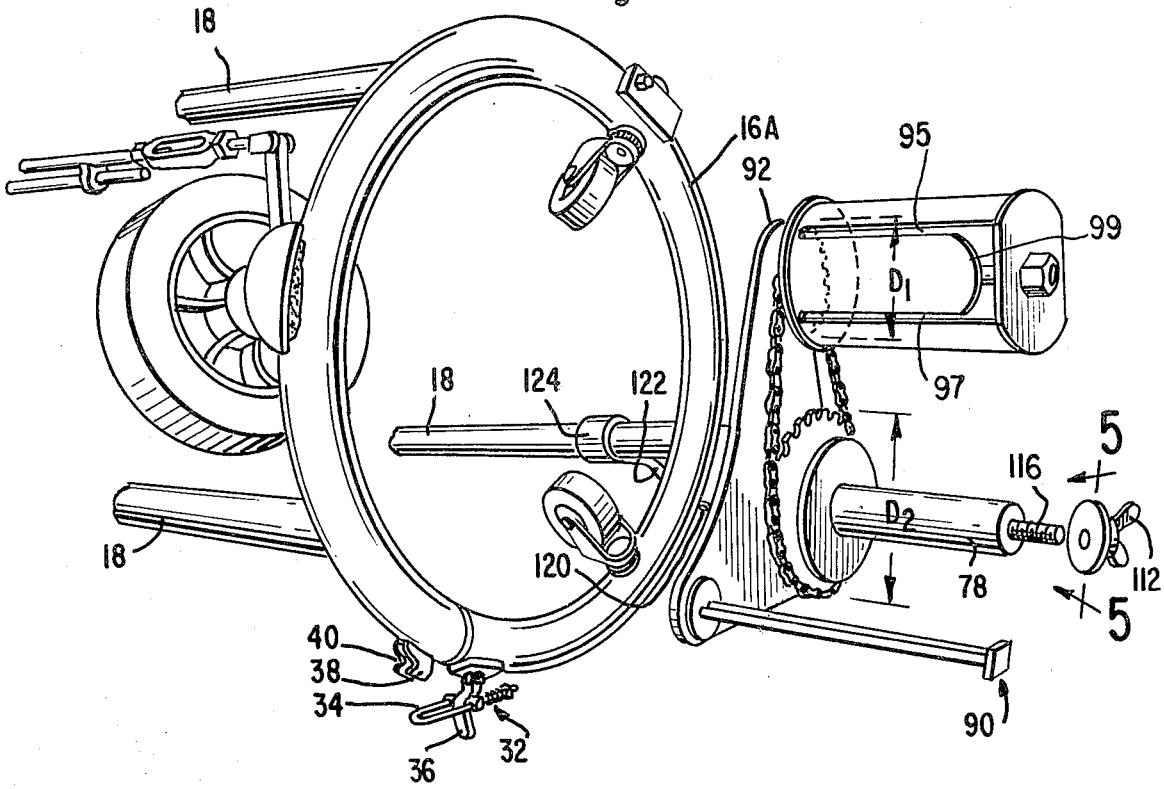
FIG. 3 is a partially broken away perspective view of the new and improved apparatus of the present invention particularly showing the sheet material feeding and tensioning assembly and frame hinge latch mechanism.

A sheet material feeding assembly generally designated by reference numeral 22 in hingedly attached to one frame member 16, as best shown in FIGS. 1 and 3.

Each annular frame member 14 and 16 is divided into two equal halves hinged together with a hinge member generally designated by reference numeral 24. The frame hinge members 24 each comprise a pair of hinge plates 26 and 28 secured to one frame half i.e. 14A, such as by welding, on opposite sides of the frame half and generally in parallel alignment and extending to overlie opposite sides of an adjacent second frame half 14B. A hinge pin 30 is inserted through an aperture in the extending portions of each of the hinge plates 26 and 28 and through an aligned aperture in the adjacent second frame portion 14B so that the second frame half 14B may be rotated about hinge pin 30 to the frame member 14 so that the apparatus 10 may be disposed initially around the conduit 12. Each frame member 14 and 16 is secured around the conduit 12 in a closed position by latching the frame members 14 and 16 together with a frame latch mechanism, generally designated by reference numeral 32, as best shown in FIG. 3. The latches 32 generally comprises a U-shaped latch member 34 hingedly disposed on a pivotable quick release member 36 secured, such as by welding, to frame member portions 14A and 16A. Frame member portions 14B and 16B have latch receiving member 38 secured thereto and disposed to receive the U-shaped latch members 34 within a notch or groove 40 in the latch receiving member 38. The frame latch mechanism 32 can be quickly opened or closed by rotating the rotatable quick release member 36 to release or secure the frame latch mechanism 32 to open or close the frame members 14 and 16.

Figure 2:
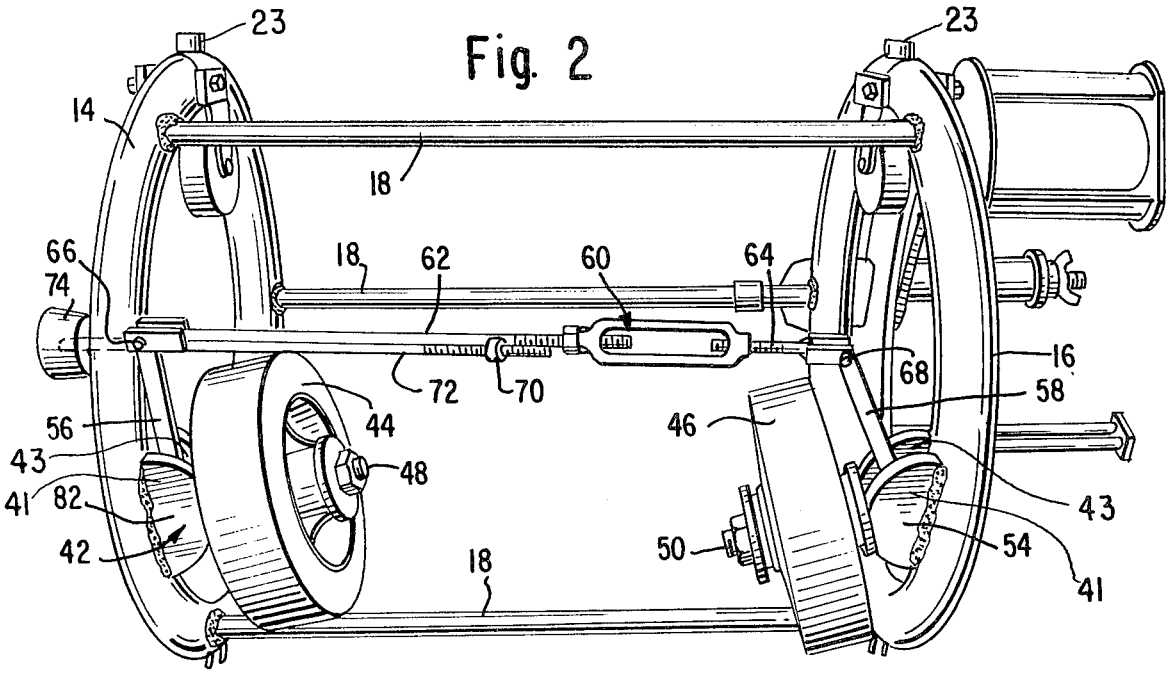
FIG. 2 is a perspective view of the new and improved apparatus of FIG. 1.

In accordance with an important feature of the present invention, a guide roller assembly, generally designated by reference numeal 42 (FIG. 2) is pivotally attached at opposite annular frame members 14 and 16 between arced parallel guide members 41 defining guide channels 43 therebetween. The guide roller assembly 42 generally comprises a pair of drive rollers 44 and 46 connected through their respective axles 48 and 50 at guide channels 43 through pivot pins 52 and 54 in the guide members 41 to elongated L-shaped turnbuckle connecting shafts or pivot arms 56 and 58 pivotally connected to a turnbuckle generally designated by reference numeral 60. The turnbuckle 60 includes elongated threaded shafts 62 and 64, respectively connected to the turnbuckle connecting shafts 56 and 58 through their respective pivot pins 66 and 68. Axially movement of the turnbuckle between the frame members 14 and 16 causes angular movement of the turnbuckle connecting shafts 56 and 58. More particularly, axial movement of the turnbuckle 60 causes angular movement of the turnbuckle connecting shaft 56 about pivot pins 52 and 66, and causes angular movement of turnbuckle connecting shaft 58 about pivot pins 54 and 68, as best shown in FIG. 2. Turnbuckle connecting shaft 56 is rigidly secured to axle 48 of drive wheel 44 at pivot pin 52 so that angular movement of turnbuckle connecting shaft 56 causes the same angular movement of drive wheel 44 with respect to the longitudinal axis of the frame members 14 and 16. Similarly, turnbuckle connecting shaft 58 is rigidly secured to the axle 50 of drive roller 46 at pivot pin 54 so that angular movement of turnbuckle connecting shaft 58 causes the same angular movement of drive wheel 46 with respect to the longitudinal axis of frame member 16. The drive wheels 44 and 46 are initially set to the same degree of angular disposition with respect to the frame members 14 and 16 by initially disposing the elongated threaded shafts 62 and 64 within the turnbuckle 60 to achieve identical angular disposition of drive wheels 44 and 46 with respect to the frame members 14 and 16. In this manner, axial movement of the turn buckle 60 with respect to the frame members 14 and 16 will cause both drive wheels 44 and 46 to be identically angularly disposed with respect to the conduit 12.

In accordance with an important feature of the present invention, the elongated turnbuckle shaft 62 has a threaded collar 70 secured thereto, such as by welding, and adapted to receive an elongated threaded shaft 72. The elongated shaft 72 extends through an enlarged opening in frame portion 14 and, at an extreme end is rigidly secured to a knurled knob 74. The elongated shaft 72 has a stop member 76 (FIG. 1) rigidly secured thereto on one side of the frame member 14 and the knurled knob 74 serves as a stop member on the other side of the frame member 14 so that shaft 72 remains axially stationary. Knob 72 can be turned to rotate shaft 72 within threaded collar 70 thereby causing axial movement of the elongated shaft members 62 and 64 to identically change the angular disposition of the drive rollers 44 and 46.

In accordance with another important feature of the present invention, as best shown in FIGS. 1 and 3, the sheet material feeding assembly 22 includes a tape roll feeding spindle 78 fixedly secured at its base 80 to a relatively large gear 82; a tape backing material take-off drum 84 fixedly secured at its base 86 to a relatively small gear 88; and a sheet material tensioning assembly generally designated by reference numeral 90 rigidly but rotationally adjustably secured to a sheet material feeding assembly base plate 92. The relatively large gear 82 secured to the tape roll feeding spindle 78 and the relatively small gear 88, secured to the tape backing material take-off drum 84, each are rotatable with respect to the sheet material feeding assembly 92 about axles 91 and 93 extending through the sheet material feeding assembly base plate 92. The gears 82 and 88 are connected through a drive chain 94 so that rotation of the tape roll feeding spindle which occurs as the tape is pulled away from a tape roll as the apparatus 10 is rotated helically around the conduit 12, causes simultaneous rotation of the tape backing material take-off drum 84 to wind the backing material thereon.

In accordance with another important feature of the present invention, the tape material take-off drum includes two spaced, parallel longitudinal slots 95 and 97 and an enlarged opening defined by a curved upper surface 99 between the slots 95 and 97 so that the tape backing material easily can be threaded over the curved upper surface 99 and through the longitudinal slots 95 and 97.

In accordance with another important feature of the present invention, as best shown in FIG. 3, the gear 82 secured to the tape roll feeding spindle is larger than the gear 88 secured to the tape backing material take-off drum 83 (i.e. 1.5 to 2.5 times the diameter of the smaller gear 88), so that the tape backing material take-off drum 84 rotates at a faster rate than the rotation of the tape roll feeding spindle 78. In this manner, constant tension will be maintained on the tape backing material as it is wound around the tape backing material take-off drum even at the beginning of tape wrapping when the tape roll is of relatively large diameter and the tape backing material take-off drum is empty. The tension in the backing material increases as the tape roll decreases in diameter and as the diameter of the backing material increases on the tape backing material take-off drum 84.

However, since the backing material is somewhat elastic, the backing material does not break during wrapping.

In accordance with another important feature of the present invention, the sheet material tensioning assembly 90 generally comprises a pair of spaced rods 96 and 98. The tape material 100, from the tape roll feeding spindle 78, is threaded between the rods 96 and 98 as shown in FIG. 1. A base 102 of the sheet material tensioning assembly 90 can be rotated about the sheet material feeding assembly base plate 92 to increase or decrease the tension applied by the rods 96 and 98 to the tape material 100 since sufficient rotation causes tape contact by both rods 96 and 98 as the tape material is being wrapped over the conduit 12, as shown in FIG. 1. Most surprisingly, it has been found that the simple threading of the tape material 100 between the parallel rods 96 and 98 will provide a predetermined adjustable and constant amount of tension to the tape material 100 close to the conduit 12 thereby eliminating the necessity of having a pressure roller forcing the tape material 100 against the surface of the conduit 12. The sheet material tensioning assembly 90 can be made rotatable about the sheet material feeding assembly base plate 92 by securing a threaded shaft 103 extending from the base 102 of sheet material tensioning assembly 90 through an aperture in the sheet material feeding assembly base plate 92 so that the sheet material tensioning assembly 90 can be rigidly secuerd to the base plate 92 in a rotationally adjustable manner.

Figure 5:
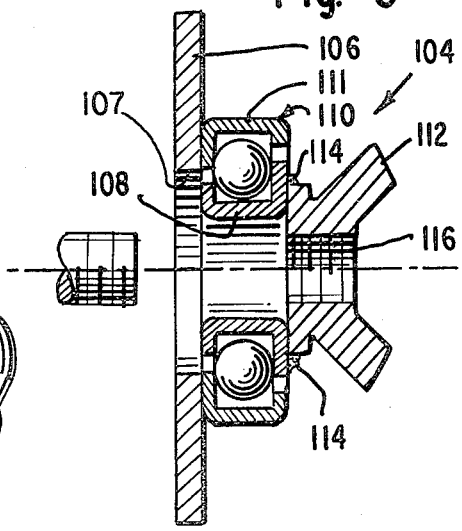
FIG. 5 is an enlarged cross-sectional view taken along the line 5—5 of FIG. 3.

In accordance with another important feature of the present invention, as best shown in FIG. 5, the tape roll feeding spindle 78 includes a new and improved tape roll locking mechanism 104 for securing a roll of tape to the tape roll feeding spindle 78. The tape roll locking mechanism 104 includes a stop member or washer 106 having a central aperture 107 disposed under a lower surface of inner diameter portion 108 of a bearing 110, so that the inner diameter portion 108 of the bearing 110 is freely rotatable. The washer 106 is fixedly secured to an outer diameter portion 111 of the bearing 110. A wing nut 112 is fixedly secured, such as by tack welds 114, to an upper surface of the inner diameter portion 108 of the bearing 110 and is adapted to threadedly receive a threaded shaft 116 of the tape roll feeding spindle 78. In this manner, the tape roll locking mechanism 104 can be manually tightened against an upper surface of a tape roll by manually turning wing nut 112 about the inner portion 108 of bearing 110 to a tight position while permitting the washer 106 and an outer diameter portion 111 of the bearing 110 to rotate freely as the tape is removed from the tape roll.

Figure 4:
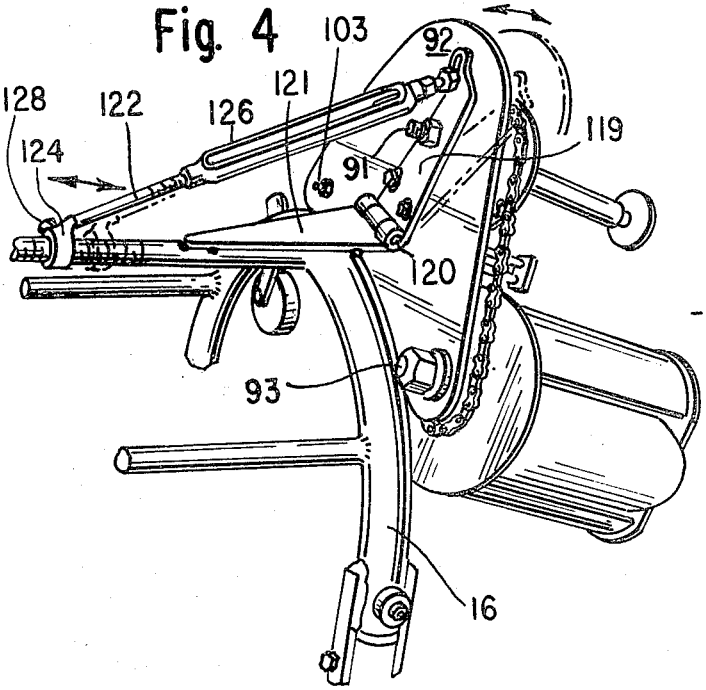
FIG. 4 is an enlarged cross sectional view of a tape backing material take-off drum, taken through the line 4—4 of FIG. 3, showing the backing material threaded threin.

In accordance with another important feature of the present invention, as best shown in FIGS. 3 and 4, the sheet material feeding assembly 22 is angularly adjustable with respect to the conduit 12 to achieve a desired degree of tape overlap by securing an elongated hinge plate 119 to a back surface of the sheet material feeding assembly base plate 92. A hinge pin 120 pivotally connects hinge plate 119 to a second hinge plate 121 secured to the frame member 16, such as by welding. The hinge plate 119 is connected to an elongated rod 122 and the rod 122 is secured at a frame-contacting end to a collar 124 slideably disposed over a structural cross member 18. By sliding the collar 124 longitudinally over the structural cross member 18, angular adjustments can be made to the entire sheet material feeding assembly 22, thereby simultaneously adjusting the angular disposition of the tape roll feeding spindle 78, the tape backing material take-off drum 84, and the sheet material tensioning assembly 90 with respect to the conduit 12. The elongated rod is threaded into a turnbuckle 126 disposed between slidable collar 124 and hinge plate 119 so that mirror adjustments can be made to the angle of the sheet material feeding assembly 22 by manually rotating turnbuckle 126 to shorten or lengthen the effective length of rod 122 between the collar 124 and the hinge plate 119, thereby decreasing or increasing the angle of the sheet material feeding assembly 22 with respect to the conduit 12. For relatively major angular adjustments of the sheet material feeding assembly 22, a set screw 128 is provided through collar 124 so that the collar 124 can be slid longitudinally over the structural cross member 18 to a desired location, and the set screw then is tightened to lock the collar 124 at the desired location. A wing nut set screw 126 is removably journalled into the collar 124 for contact against the structural cross member 18 when the angular adjustment of the sheet material feed assembly has been set for a desired predetermined amount of tape overlap.

What is claimed and desired to be secured by Letters Patent is:

1. Apparatus for wrapping an elongated conduit with sheet material comprising:

a frame assembly adapted to circumscribe a conduit;

means for retaining said conduit within said frame assembly while said frame assembly is rotated around said conduit during wrapping of said sheet material on said conduit;

means for feeding a strip of said sheet material against an outer surface of said conduit;

an axially rotatable sheet material tensioning means disposed between said feeding means and said conduit, said tensioning means including a channel defined by a pair of parallel, spaced sheet material guide members, spaced to form a channel wider than that thickness of said sheet material;

a backing material take-up means for collecting a backing material from said sheet material as said sheet material is wrapped on said conduit; and, means for interconnecting said sheet material feeding means to said backing material take-up means so that rotational movement of said sheet material feeding means causes simultaneous rotational movement of said backing material take-up means;

said sheet material feeding means comprising a first elongated reel secured to a first means for rotating said first elongated reel and said backing material take-up means comprising a second elongated reel secured to a second means for rotating said second elongated reel, with said first and second reel rotating means being interconnected by said interconnecting means.

2. Apparatus as defined in claim 1 wherein said first and second reel rotating means comprise first and second gears operatively connected to said first and second elongated reels.

3. Apparatus as defined in claim 2 wherein said firt gear secured to said first elongated reel has a diameter of 1.5 to 2.5 times as large as a diameter of said second gear secured to said second elongated reel.

4. Apparatus for wrapping an elongated conduit with sheet material comprising:

a frame assembly adapted to circumscribe a conduit;

means for retaining said conduit within said frame assembly while said frame assembly is rotated around said conduit during wrapping of said sheet material on said conduit;

means for feeding a strip of said sheet material against an outer surface of said conduit;

an axially rotatable sheet material tensioning means disposed between said feeding means and said conduit, said tensioning means including a channel defined by a pair of parallel, spaced sheet material guide members, spaced to form a channel wider than that thickness of said sheet material;

said sheet material feeding means and said sheet material tensioning means being secured to a common feeding assembly support means, and means for pivotally connecting said feeding assembly support means to said frame assembly so that pivoting of said feeding assembly support means simultaneously and identically pivots said sheet material feeding means and said sheet material tensioning means with respect to said conduit.

5. Apparatus as defined in claim 4 further including a backing material take-up means secured to said feeding assembly support means so that the sheet material feeding means, the sheet material tensioning means, and the backing material take-up means are all simultaneously and identically pivoted with respect to said conduit when said feeding assembly support means is pivoted.

6. Apparatus for wrapping an elongated conduit with sheet material comprising:

a frame assembly adapted to circumscribe a conduit;

means for retaining said conduit within said frame assembly while said frame assembly is rotated around said conduit during wrapping of said sheet material on said conduit; and means for adjusting an amount of longitudinal travel of said apparatus along said conduit per revolution of said apparatus around said conduit, said means for adjusting comprising an elongated member longitudinally movable with respect to said conduit, said elongated member being pivotally connected through a pair of pivot arms to a pair of frame assembly wheels so that longitudinal movement of said elongated member causes angular movement of said wheels with respect to said conduit.

7. Apparatus as defined in claim 6 wherein said elongated member includes an extending shaft connected to said frame assembly and operatively connected to said elongated member so that rotation of said shaft causes longitudinal movement of said elongated member to identically change an angular disposition of both of said wheels with respect to said conduit.

8. Apparatus as defined in claim 7 wherein rotation of said shaft does not cause axial movement of said shaft with respect to said conduit.

9. Apparatus as defined in claim 6 further including a backing material take-up means for collecting a backing material from said sheet material as said sheet material is wrapped on said conduit.

10. Apparatus as defined in claim 9 wherein said backing material take-up means includes a pair of elongated channels for receiving said backing material and an enlarged opening interconnecting said channels for receiving said backing material.

11. Apparatus for wrapping an elongated conduit with sheet material comprising:

a frame assembly adapted to circumscribe a conduit;

means for retaining said conduit within said frame assembly while said frame assembly is rotated around said conduit during wrapping of said sheet material on said conduit;

means for feeding a strip of said sheet material against an outer surface of said conduit;

an axially rotatable sheet material tensioning means disposed between said feeding means and said conduit, said tensioning means including a channel defined by a pair of parallel, spaced sheet material guide members, spaced to form a channel wider than that thickness of said sheet material;

and including a sheet material securing means for rotatably securing a roll of sheet material onto said sheet material feeding means wherein said securing means includes a stop member secured on one side of a bearing assembly and a threaded means secured to an opposite side of said bearing assembly, said threaded means adapted to be received over a threaded shaft extending from said sheet material feeding means so that said stop member can be tightened against a roll of sheet material by turning said threaded means onto said threaded shaft while permitting bearing rotation during rotation of said sheet material feeding means, without causing loosening of said threaded means.

* * * * *